US005531949A

United States Patent [19]

Heitfiled

[11] Patent Number: 5,531,949

[45] Date of Patent: Jul. 2, 1996

[54] METHODS AND MOLDS FOR MAKING A ROLLER SKATING WHEEL HAVING CURVILINEAR PATHS THROUGH THE HUB

[75] Inventor: Richard V. Heitfiled, Reston, Va.

[73] Assignee: Creative Urethanes, Purcellville, Va.

[21] Appl. No.: 259,002

[22] Filed: Jun. 13, 1994

Related U.S. Application Data

[60] Continuation-in-part of Ser. No. 258,222, Jun. 10, 1994, abandoned, which is a division of Ser. No. 15,154, Feb. 11, 1993, Pat. No. 5,320,417.

[51] Int. Cl.[6] ..... B29C 33/40; B29C 33/50; B29C 39/10

[52] U.S. Cl. ..... 264/135; 249/56; 249/64; 249/134; 249/142; 249/155; 249/176; 249/183; 264/161; 264/274; 264/278; 264/313; 425/175

[58] Field of Search ..... 249/56, 64, 134, 249/142, 155, 176, 177, 183, 123; 264/135, 161, 162, 274, 275, 278, 313; 425/175, DIG. 32

[56] References Cited

U.S. PATENT DOCUMENTS

| | | | |
|---|---|---|---|
| 1,394,589 | 10/1921 | Swinehart | 152/326 |
| 1,591,982 | 7/1926 | Kirkwood | 152/326 |
| 1,662,007 | 3/1928 | Kuhlke | 152/326 X |
| 1,702,081 | 2/1929 | Hatfield | 152/326 X |
| 3,498,363 | 3/1970 | Spindler | 249/56 |
| 3,762,677 | 10/1973 | Adams | 249/141 |
| 3,992,025 | 11/1976 | Amelio | 301/5.7 X |
| 4,248,823 | 2/1981 | Bader et al. | 249/176 |
| 4,664,615 | 5/1987 | Ohtomo et al. | 249/123 |
| 4,879,794 | 11/1989 | Djerf | 264/274 |
| 4,963,083 | 10/1990 | Stalter, Sr. et al. | 249/176 |
| 4,971,746 | 11/1990 | Ferrer | 264/313 |
| 5,312,844 | 5/1994 | Gonsior et al. | 425/554 |

FOREIGN PATENT DOCUMENTS

| | | | |
|---|---|---|---|
| 324772 | 11/1918 | Germany | 244/103 S |
| 705423 | 5/1966 | Italy | 249/142 |

*Primary Examiner*—Robert B. Davis
*Attorney, Agent, or Firm*—Watson Cole Stevens Davis

[57] ABSTRACT

A method and mold for making a wheel of a roller skate including a plurality of circumferentially spaced apart generally axially extending curvilinear paths. A speed skater, traveling a predominately circular course with such wheels properly aligned on such skates, is able to use air moving past the skater to increase skating speed. As air enters the curvilinear paths of the wheel the direction of air flow changes. In this manner, momentum is transferred from the moving air to the spinning wheels, thus increasing the number of revolutions of the wheel and the speed of the skater. The mold may be formed of polyurethane and use flexible fingers to form the curvilinear paths of the wheel.

15 Claims, 6 Drawing Sheets

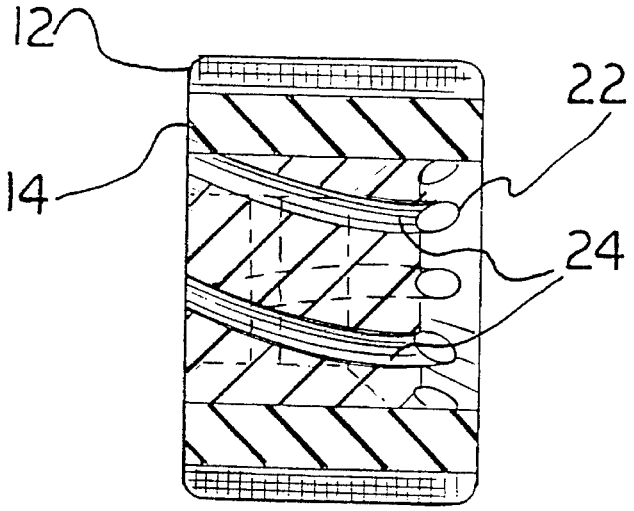
FIG. 3
FIG. 6
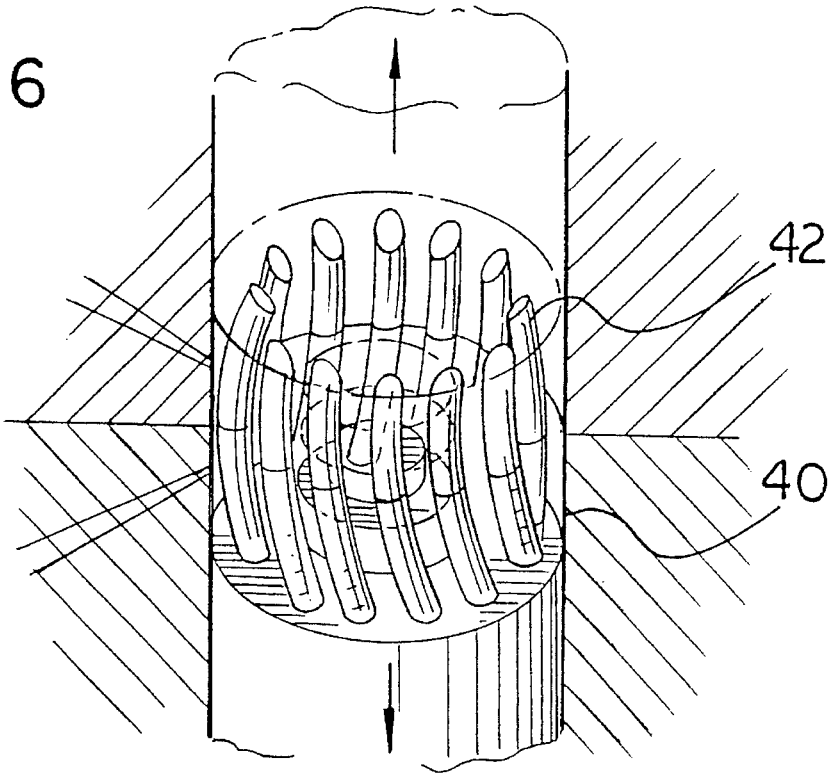

METHODS AND MOLDS FOR MAKING A ROLLER SKATING WHEEL HAVING CURVILINEAR PATHS THROUGH THE HUB

RELATED APPLICATION

This application is a continuation-in-part of application Ser. No. 08/258,222, filed Jun. 10, 1994, now abandoned, which in turn is a division of application Ser. No. 08/015,154 filed Feb. 11, 1993, now U.S. Pat. No. 5,320,417, the disclosure of which is hereby incorporated by reference.

FIELD OF THE INVENTION

The invention relates to improvements to methods and molds for making the wheel of a speed roller skate, and more specifically to the hub of the wheel.

BACKGROUND OF THE INVENTION

In the world of roller speed skating, as in many activities today, it is believed that athletes are reaching thresholds of performance which cannot be surpassed by relying solely on the human factor. There is just simply a limit to what the human body, by itself, can achieve. Currently, speed skaters are reaching maximum speeds, around a predominately circular course, of thirty miles per hour.

In view of such limits, more and more athletes seek improvements in the equipment they use to best their competition and achieve record setting results. One way to attempt to improve such equipment is to make the equipment lighter. For instance, it is known to drill a plurality of paths having a circular cross section through the hub of a roller skating wheel, parallel to the axis of rotation of the wheel. Such drilling lightens the hub and is ornamentally attractive. However, any improvement achieved in increased speeds is practically unmeasurable.

The present invention is an improvement in methods and molds for making a hub of the wheel of a roller skate that produces measurable improvements in speed skating performance.

SUMMARY OF THE INVENTION

The improvement to the wheel of a roller skate includes a plurality of spaced apart and circumferentially arranged curvilinear paths extending generally axially through the hub. A speed skater, traveling a predominately circular course with such wheels properly aligned on roller skates, is able to use air moving past the skater to increase skating speed. As air enters the curvilinear paths of the wheel the direction of air flow changes. In this manner, momentum is transferred from the moving air to the spinning wheels, thus increasing the speed and number of revolutions of the wheel.

An object of the present invention is to provide a first mold system for making a roller skate wheel, preferably having the above-mentioned characteristics.

Another object of the present invention is to provide a method of making a roller skate wheel, preferably having the above-mentioned characteristics.

Another object of the present invention is to provide a second generation mold system for making a roller skate wheel, preferably having the above-mentioned characteristics.

Another object of the present invention is to provide a casting die for making the second generation mold system.

A still further object of the present invention is to provide a method of making a roller skating wheel, preferably having the above-mentioned characteristics in accordance with the second mold system.

Other objects, features and advantages of the present invention will become apparent from the detailed description of the invention.

BRIEF DESCRIPTION OF SEVERAL VIEWS OF THE DRAWINGS

FIG. 3 side view in sectional view of the wheel of FIG. 2;

FIG. 6 is a perspective of a first generation mold;

DETAILED DESCRIPTION OF THE INVENTION

Figure 1A:
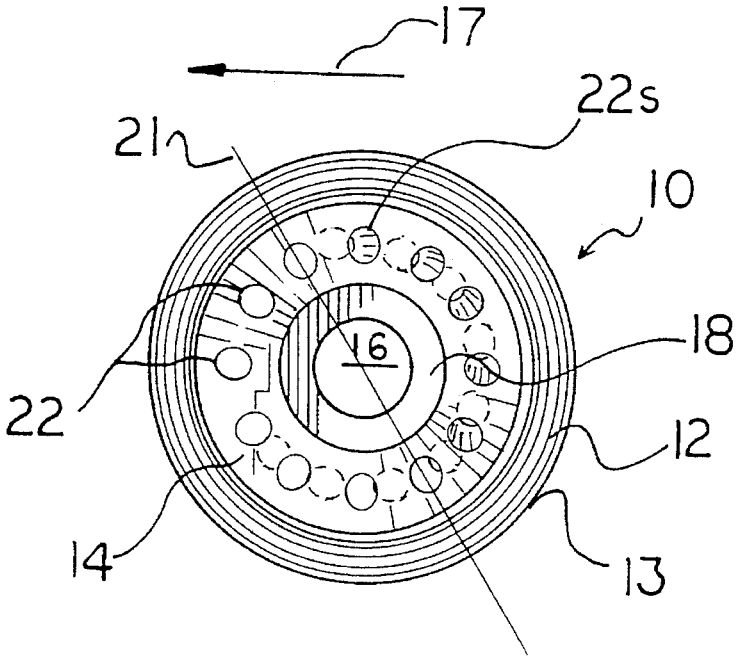
FIG. 1*a* is a front view of a left-handed wheel of the present invention.
Figure 1B:
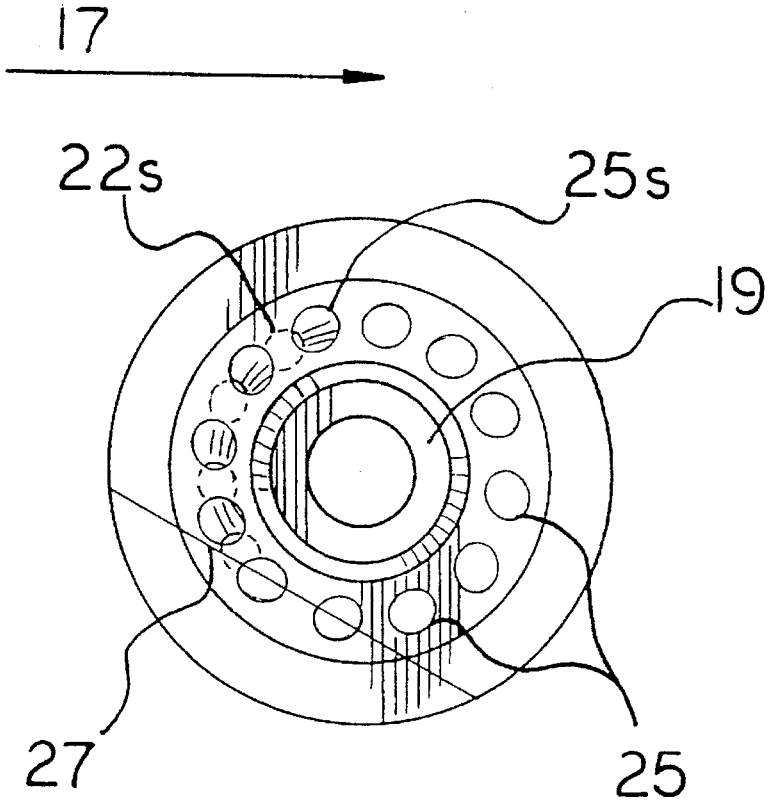
FIG. 1*b* is a back view of the left-handed wheel of the present invention.

FIGS. 1*a* and 1*b* show front and back faces of a left-handed wheel 10 of a roller skate of the invention. The wheels are usually composed of a polyurethane tire 12, having a peripheral surface 13, heat sealed to the rim of hubs 14, which are also usually made of a polyurethane composition.

Viewing the wheel 10 from its front and looking from the inside thereof and working backward, as shown in FIG. 1*a*, it is seen that hub 14 has a central circular opening 16, the center of which defines the axis of rotation of the hub. In front of central opening 16 and coaxial thereto is circular seat 18 having a diameter larger than the diameter of central opening 16. Central opening 16 receives an axle (not shown); seat 18 receives bearings (not shown) and an axle fastening member (not shown) such as a nut. From the end of circular seat 18 to any point axially positioned on the hub in front of seat 18 the opening expands radially outwardly and generally uniformly in the axial direction, such that the inside surface of the hub defines the boundaries of a truncated cone.

As shown in FIG. 1*a* positioned on the truncated surface of hub 14, radially inwardly from the peripheral surface of the wheel, are a plurality of elliptically-shaped openings 22. Openings 22 are spaced apart circumferentially on hub 14 about central opening 16. As shown, twelve openings are equally spaced apart by about thirty degrees. However, equal spacing and the number of openings is optional. Elliptically-shaped openings 22 are so aligned that a line 21 connecting the foci of one elliptically-shaped opening will intersect all other such lines, defined by the foci of each ellipse, at the axis of rotation of the wheel such that a plurality of radii are formed by such lines.

Openings 22 are the openings for paths or air passages 24 (more clearly shown in FIG. 3), which extend through hub 14 generally in the axial direction. Paths 24 are not linear such that straight paths are formed, but curvilinear as shown in FIG. 3 such that the a path 24 through the hub resembles a section of a circle i.e., a minor arc of such circle. When looking through path, from the opening designated 22*s* (positioned at 12:00 o'clock on the wheel of FIG. 1*a*) of a stationary wheel, the path is shown to curve to the left and terminates at rear opening 25*s* of hub 14 as shown in FIG. 1*b*. A plane intersecting a path 24 perpendicular to the axis of rotation of the hub will show that the cross section of the path is circular. Relative to the direction of rotation of the wheel, which is indicated by arrow 17 in several of the drawing figures, opening 25*s* is positioned ahead of its counterpart opening 22*s* at 12:00 o'clock. The reverse is true after a half revolution of the wheel. This positioning, of course, is the result of the curvilinear path 24. The fact that openings 25, as shown in FIG. 1*b*, are elliptically shaped is also due to the fact that the paths 24 are curvilinear. As shown in FIG. 1*b*, line 27 connecting the foci of an opening 25 forms a chord relative to the circumference of hub 12. The elliptical shape of openings 22 is caused by the cone-shaped surface of the hub. The back face of the wheel of the invention, as shown in the FIG. 1*b*, includes the opposite end of central opening 16 and a second seat 19 similar to seat 18 for receiving bearings (not shown). The back face of the wheel, as shown, is relatively flat.

Hub 14 has an axial length of about 3.5 cm (1.37 inches) and a diameter of 4.5 cm (1.77 inches). The axial length of tire 12 is slightly greater than the axial length of hub 14 as shown in FIG. 1*a*. The diameter of paths 24 are generally equal and are approximately 0.476 cm (0.1875 inches). The openings 22 and 25, located radially inwardly from the periphery of the wheel, are located an equal distance (as measured from their centers) from the periphery. This distance is approximately 1.25 cm (0.492 inches). Preferably the radial distance of openings 25 on the back face of the hub (as measured from their centers to the peripheral surface of the hub) is less than the radial distance of openings 22. The wheel shown in FIGS. 1*a* and 1*b* having paths 24 curving to the left as described above are deemed left-handed wheels for reasons which will become clearer, infra.

Figure 2A:
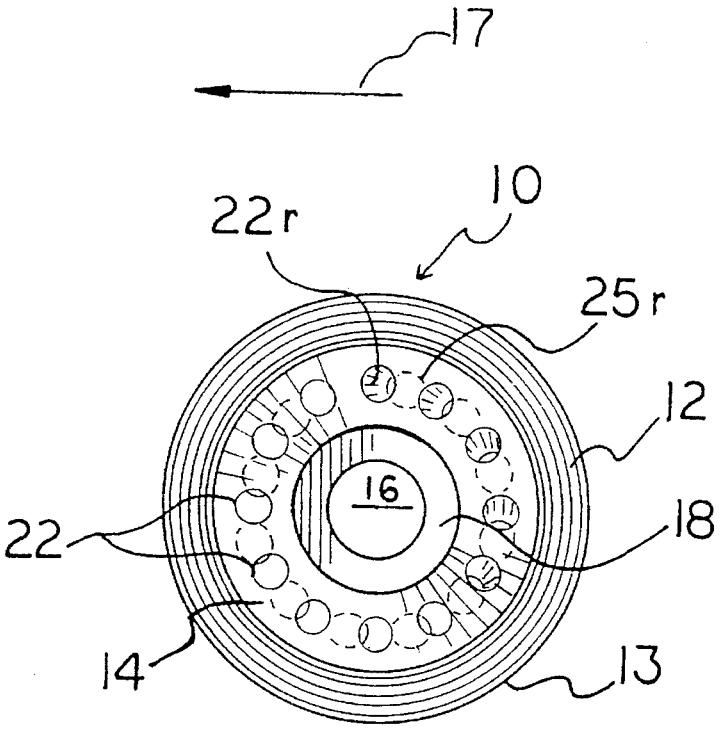
FIG. 2*a* is a front view of a right-handed wheel of the present invention.
Figure 2B:
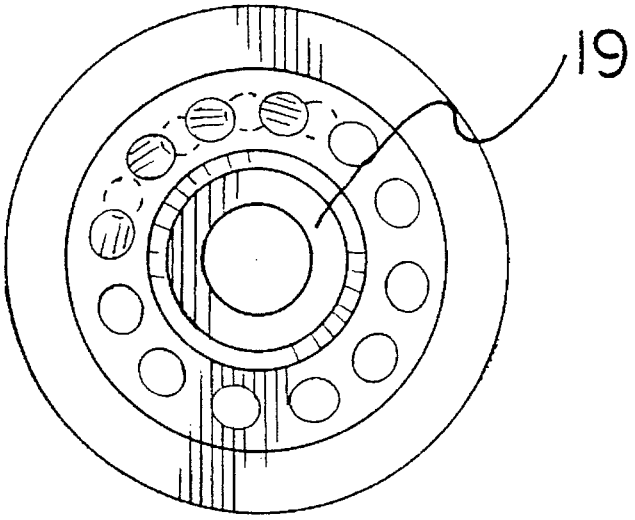
FIG. 2*b* is a back view of a right-handed wheel of the present invention.

Shown in FIGS. 2*a* and 2*b* are wheels which in all respects are similar to the wheels shown in FIGS. 1*a* and 1*b* except for the direction of the curve of paths 24. When looking through the path from the opening designated 22*r* (at 12 o'clock) of the stationary wheel of FIG. 2*a* the path is shown to curve to the right rather than to the left. Because of the direction that path 24 takes in the hub of FIGS. 2*a* and 2*b* opening 25*r*, relative to the direction of the rotation of the wheel, again designated by arrow 17, is positioned behind its counterpart opening 22*r*. The wheel shown in FIGS. 2*a* and 2*b* having paths 24 curving to the right as described above are deemed right-handed wheels for reasons which will become clearer, infra.

Figure 4:
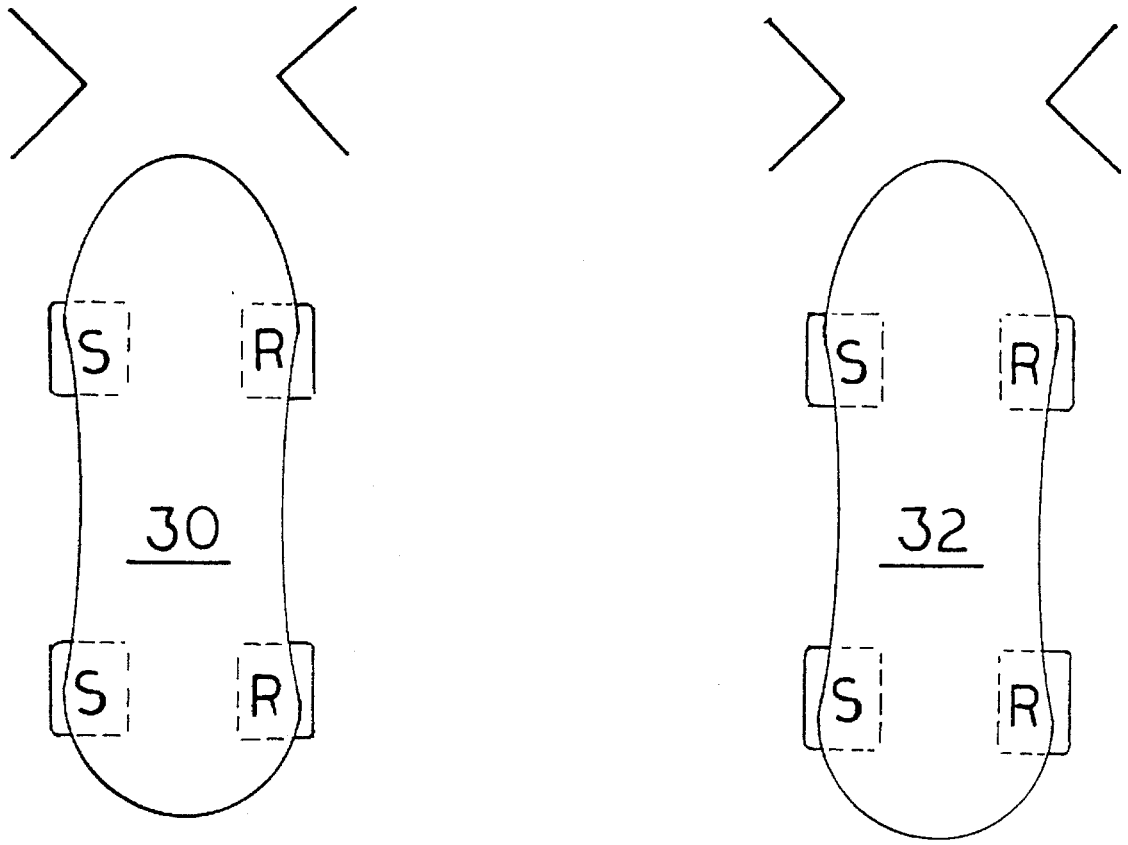
FIG. 4 is a schematic top view of a pair of skates on the left and right feet of a skater.

Shown in FIG. 4 is a schematic top view of a pair of skates, left skate 30 and right skate 32. Mounted to left-footed skate 30, on the left-hand side thereof, are front and rear left-handed wheels of FIG. 1*a* (designated with the letter "S"). The wheels are so mounted such that the front face of the wheel, i.e., the truncated cone-shaped face, is facing away from the skater. This is designated in the drawing by the > sign. The wheels are mounted such that the front face of hub 14, on the left hand side of the skate is exposed to the relative wind as the skater skates counter-clockwise around the skating rink and the flat side thereof is closet to the skate body. On the right side of skate 30 are mounted front and rear right-handed wheels (designated with the letter "R") such that the front face is on the outside of each wheel. The facing is designated by the < sign. The flat or rear face is mounted closet to the skate body.

Mounted to the left side of skate 32, as shown in FIG. 4 are front and rear left-handed wheels (designated as above) such that the front face thereof, as shown in FIG. 1*a* faces away from the skate body, again designated by the > sign. Mounted to the right-hand side of the front and rear of skate 32 are right-handed wheels shown in FIGS. 2 such that the face of the wheel shown FIG. 2*a* is facing outward away from the skater as designated by the < sign.

Figure 5:
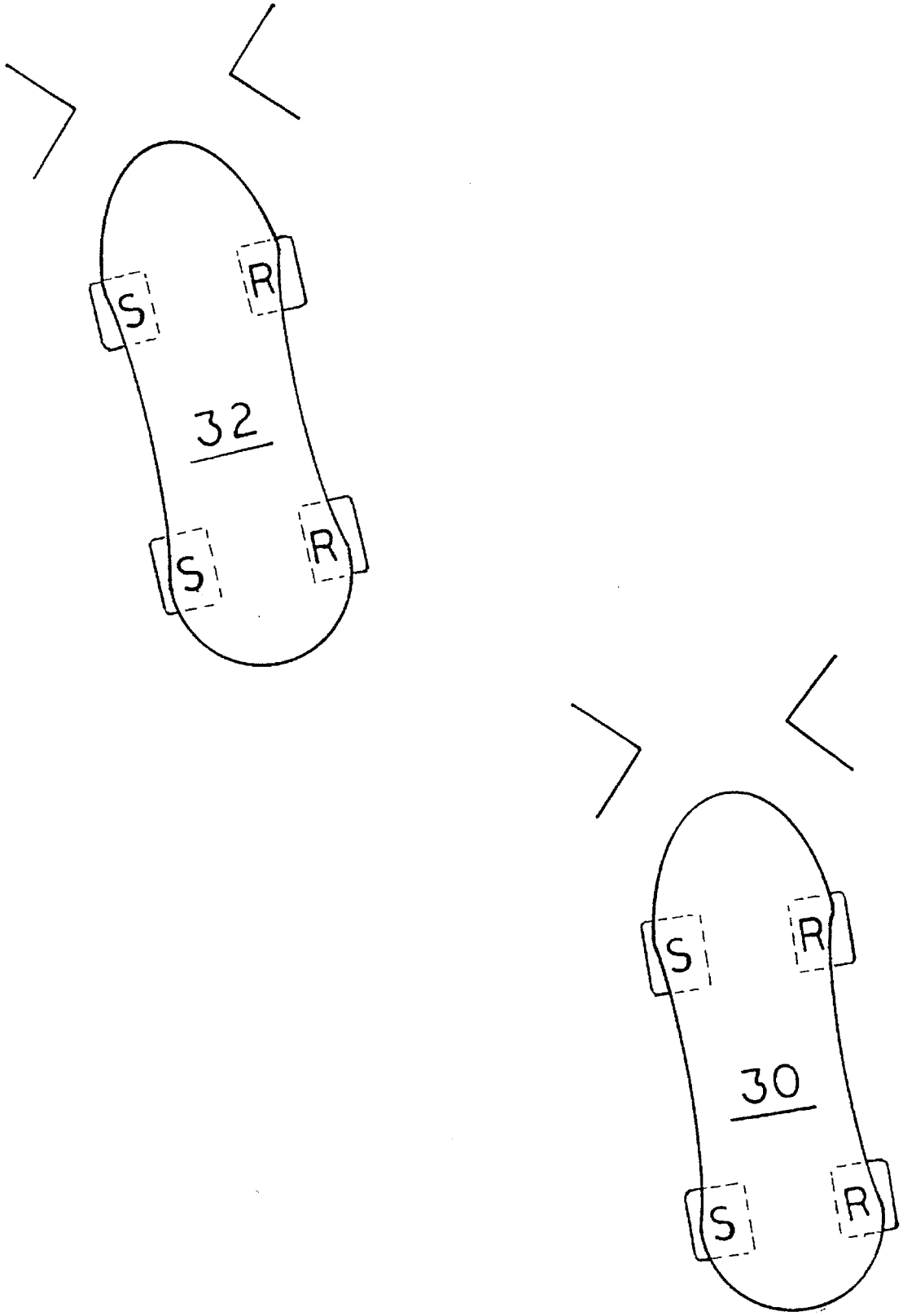
FIG. 5 is a schematic top view of a pair of skates on a skater making a left circular turn.

The wheels attached to the skates as indicated above, and used by a skater racing on a circular rink in the counter-clockwise direction, will experience an increase in angular momentum (without the skater exerting any additional energy beyond that required for turning) when the skater crosses his right leg over the left to turn (see FIG. 5). That is, when the skater changes direction such that his skates are angled at least about twenty-eight degrees relative to the wind (flow of air past the skater), air enters the curvilinear paths 24 of the wheels. The curvilinear paths 24 change the direction of the air flow. In this manner, momentum is transferred from the moving air to the spinning wheels, thus increasing the number of revolutions of the wheel. The increase may be between 15 and 30%. Since the competitive rink is small the skater is actually turning for greater distances than the skater is skating on a straightaway. Accordingly, the increase in angular momentum imparted to the wheels is significant during the course of the race.

The wheels of the invention were first produced in batch by pouring polyurethane compositions into respective right- and left-handed one-piece prototype molds of FIG. 6. A mold 40 similar to the mold for producing the wheel of FIGS. 1 is shown in FIG. 6. Mold 40 includes twelve circumferentially arranged rigid elongated and curved stainless steel or aluminum cylindrical fingers 42 which create paths or air passages 24 of wheels 12 during the molding process. The mold was painstakingly hand-fashioned and the metal fingers were individually bent. Of course, it was necessary to ensure that the fingers had a similar curvature and were positioned accurately within the mold. Polyurethane liquid compositions were then poured into the mold, and after reasonable cooling the wheel was pulled, with difficulty, from the mold. It was believed at the time the prototype was made that a process for making the wheels could be automated. The process of making such wheels with a two-part segmented mold was then undertaken. However, it become evident that a two-segmented mold, besides having its own manufacturing hurdles to overcome would have required, inter alia, moving parts along a manufacturing line or a dexterity from manual laborers above that of average workers, making start-up operations and skilled labor expensive.

Confronted with these problems and knowing injection molding of the wheel was impractical given available resources, the present inventors fabricated a polyurethane mold having flexible polyurethane fingers that is used in association with a pin and a finger-alignment member. After the wheel is machined a second polyurethane mold member is used to mold a tire to the wheel member.

Figure 7:
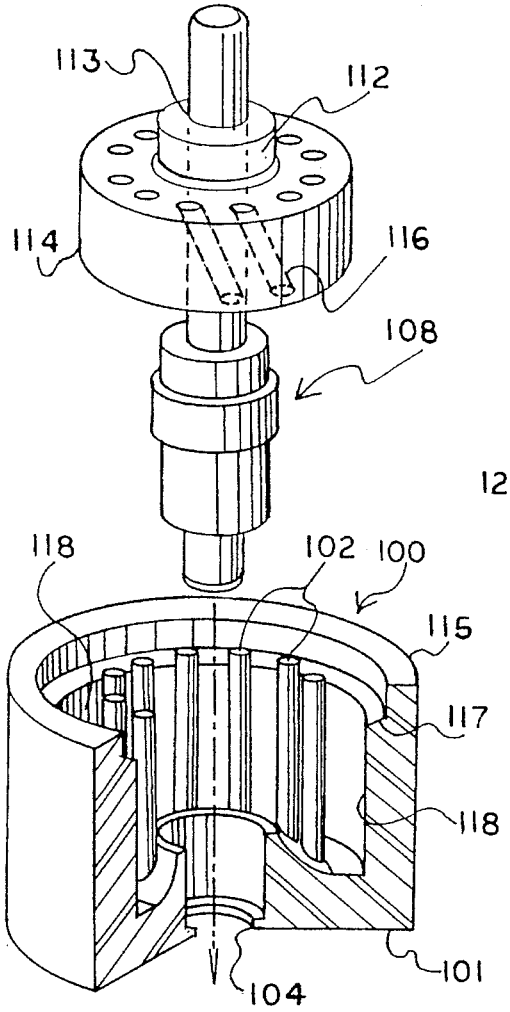
FIG. 7 is a perspective exploded view of a second generation mold and parts thereof used to create hubs of the invention.
Figure 10:
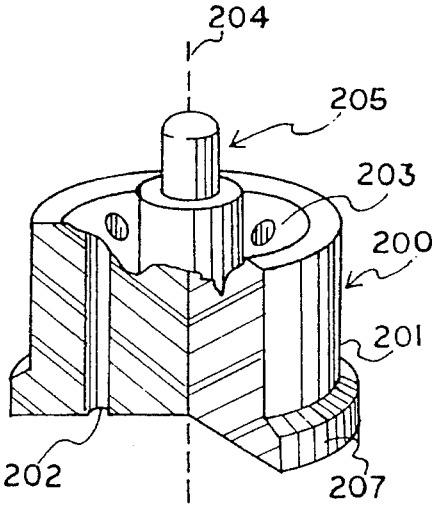
FIG. 10 is a partial section view of a die for making the mold of FIG. 7.

More particularly with reference to FIG. 7, a polyurethane mold member 100 shown in section is made from die 200 (FIG. 10). Metal die 200 is machined from an ingot of metal which is preferably aluminum. Machining the ingot includes forming a rounded continuous solid wall 201, a depending top surface 203 converging to an axially extending projection member 205 and a skirt-base 207. The die 200 includes a plurality of bores 202 circumferentially positioned about a central axis 204 of the die 200 and substantially parallel thereto.

To produce mold 100 from die 200, die 200 is dropped into a cylindrical metal sleeve or cup-shaped member (not shown), so that the skirt-base 207 rests at the bottom inside surface of the cup-shaped member. The cup-shaped member has an inner diameter larger than the outer diameter of skirt-base 207, to allow for the formation of upper wall 115 of member 100 with a desired height and thickness. Next, a polyurethane composition, preferably having a shore hardness of 92A when cured, is poured into the cup-shaped member and over the die 200. Upon cooling, the cylindrical metal sleeve or the cup-shaped member is removed from the assembly and mold 100 having structures complementary to die 200 is removed from die 200.

The hub molding unit of the invention for forming hub 14 as shown in FIG. 7 comprises a polyurethane mold member 100 having a plurality of flexible polyurethane fingers 102 circumferentially positioned around the central axis of bore 104 of the mold 100. The base 101 of the mold member is provided with an upwardly extending projection 106, on the wall of which fingers 102 are disposed, to form the conical type construction of the outer portion of the hub 14. As shown, the bottom portion of pin 108 is selectably engageable with the surfaces defining bore 104 of mold member 100. Pin 108 is provided with a plurality of different diameters so as to form circular seat 18, central bore 16 and second seat 19 in hub 14. Pin 108 is preferably made from aluminum.

The hub-molding unit includes finger alignment member 110 having a center sleeve 112, preferably made from metal, having a centrally located bore or hole 113 with an inner diameter dimensioned to slidably engage with the head of pin 108. An outer sleeve 114, preferably made from polyurethane, is molded around center sleeve 112. Outer sleeve 114 includes a plurality of angled bores or passages (curvilinear paths) 116, circumferentially disposed thereabout and passing therethrough. The bores may be machine-drilled in association with a template to ensure proper alignment and consistent direction. Alternatively, outer sleeve 114 may be cast so as to form bores 116. The number of angled bores 116 is identical to the number of fingers 102, and in one preferred embodiment such number is 12. All of bores 116 are angled in the same direction (which direction is chosen based upon whether right-handed hubs or left-handed hubs are being produced). The angles of bores 116 are preferably between 5 and 20 degrees with respect to the center axis of outer sleeve 114. However, if it is desired to produce a hub having straight through bores as described, supra, bores 116 may be formed so as to be substantially parallel to the center axis of the outer sleeve 114. Outer sleeve 114 is constructed to have an outer diameter which is smaller than the inner diameter of inner wall 118 of mold 100 including shelf structure 117 which is produced by complementary structure skirt-base 207 (FIG. 10) of mold member 200.

Figure 8:
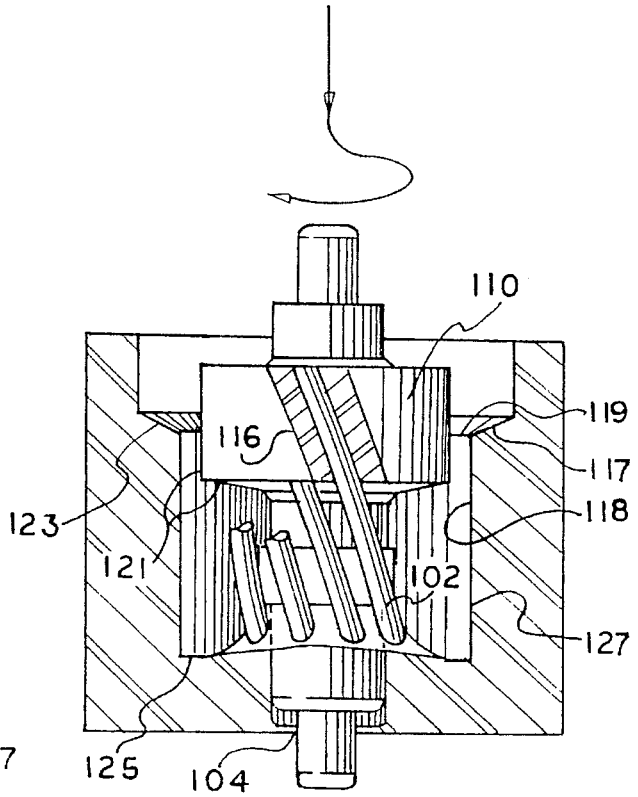
FIG. 8 is a partial section view of the mold and parts thereof of FIG. 7 disposed in the operative mode.

The operation of the molding unit is described as follows: First mold member 100 is lubricated, preferably with machine oil to prevent wear of the flexible parts and to aid in hub release. Next, referring to FIG. 8, finger alignment member 110 is slidably positioned on pin 108, and the bottom of pin 108 is positioned within bore 104 of mold 100. Fingers 102 are respectively received, with a little prodding, in the angled bores 116 of finger alignment member 110 by applying an even pressure to member 110 in the downward direction over the fingers and slightly turning the member in the direction shown by the arrow in FIG. 8. Due to the angled arrangement of bores 116, fingers 102 are bent so as to assume a curvilinear shape. The curvilinear shape of fingers 102, upon molding, provides the curved passages 24 of hub 14 (see FIG. 3). The bores 116 of finger alignment member 110 may receive portions of the fingers as shown or a smaller portion of the fingers. Next a polyurethane composition, preferably having a shore hardness of 85D when cured, is poured into the mold in the space 119 provided between outer sleeve 114 and inner wall 118 of mold 100 until it reaches a level at about or slightly above shelf structure 117. After cooling to about 190° C., pin 108 is pushed upwardly out of mold 100, by pushing or applying an upwardly directed force on the bottom of pin 108, thus releasing finger alignment member 110 and the newly formed hub (shown generally in any of FIGS. 1 and 2) from the mold 100. The finger members 102 of mold 100 have a certain degree of elasticity or shape-memory and return to a substantially linear position as shown in FIG. 7 upon removal of finger alignment member 110.

The produced hub 14 (a portion of which is shown in the left-hand side of FIG. 8, the remaining portion being excluded to show detail of the fingers and the finger alignment member) includes, inter alia, air passages, a conical center complementary to structure 106 of mold 100, a circular wall portion 125 having a thickness, a rimmed top 123 formed by the polyurethane composition flowing over shelf structure 117 of mold 100 and a well 121 (FIG. 9) having dimensions complementary to the finger alignment member and to the depth that the finger alignment member is pushed onto the fingers of mold 100.

Figure 9:
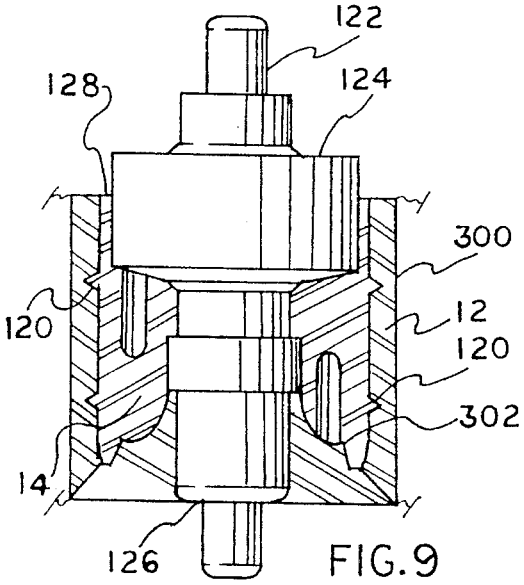
FIG. 9 is a partial section view of the mold and parts thereof used to mold tires on the hubs.

The hub removed from mold 100 is machined to remove unwanted molding structures such as the rim described above and to form mechanical interlocks 120 (see FIG. 9). The interlocks 120 are created by axially mounting the hub, spinning the same and planing the circumferential surface 127 thereof, thus reducing the thickness of wall portion 125.

Referring to FIG. 9, hub 14 is then disposed, after machining, on a second pin 122 similar to pin 108. Since FIG. 9 shows a cross section of hub 14 in one plane, and paths 24 are curvilinear only a portion of each path 24 may be seen in the figure, and pin 122 and hub 14 are disposed within tire mold 300, which is preferably a polyurethane composition similar or identical to that of mold 100. The bottom of pin 122 engages the surfaces of mold 300 defining a hole or pin receiving structure 126 of mold 300. Cap 124 preferably made from solid aluminum and having an outer diameter less than the inner diameter of the mold 300 is slidingly received on the head of pin 122 and is positioned within and on well 121 created by finger alignment member 110 during hub molding. Bottom of mold 300 has a shoulder 302, on which the reduced wall portion 125 of hub 14 rests, so as to allow the tire to form beyond the axial extent of hub 14. Subsequently, polyurethane is poured into mold 300 through the gap 128 defined by the difference in the inner diameter of mold member 300 and the outer diameter of hub 14 to form tire 12. The polyurethane pour reaches to a level slightly above the bottom or to the bottom of cap 124. Preferably, the composition of the tire is a polyurethane having a shore hardness of 94A when cured which is a composition having greater resiliency than the composition of the hub (i.e., the tire composition is softer). Mechanical interlocks 120 serve to enhance the structural interconnection between hub 14 and tire 12. Alternatively, instead of providing interlocks 120 or in association with the interlocks, the circumferential surface of hub 14 can be provided with an adhesive to ensure attachment of tire 12 to hub 114. After the tire pour has cooled, pin 122 is pushed up and out of mold 300 by pushing or applying a force to the bottom of pin 122 and a roller skate wheel is released from the mold. Subsequently, the roller skate wheel may be machined further to remove molding structure such as the well and any tire portion molded above the well and the tire may be grooved for added traction.

Although the above description has been directed towards the manufacture of quad-type roller skates, the present invention encompasses the manufacture of roller skate wheels for in-line type roller skates.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

For example, mold member 100 may be used to mold hubs having straight air passages or air passages at any desired angle.

What is claimed is:

1. A mold apparatus for making a hub of a roller skate wheel, the hub having curvilinear air passages therethrough, said apparatus comprising:

a mold member having an open top and a bottom having a bore formed therethrough;

a plurality of flexible fingers projecting from the bottom of said mold member and circumferentially surrounding said bore;

a pin disposable within said mold member and having a bottom portion selectively engageable with mold surfaces defining said bore;

a finger alignment member operatively associated with said pin and having a plurality of circumferentially arranged curvilinear paths therethrough, said curvilinear paths extending obliquely with respect to a center axis of said finger alignment member and being dimensioned to receive said flexible fingers such that when said flexible fingers are received by said curvilinear paths said flexible fingers assume a curvilinear shape.

2. A mold apparatus for making a hub of a roller skate wheel, the hub having curvilinear air paths therethrough, said apparatus comprising:

a mold member having an open top and a bottom surface; and a plurality of flexible elongated fingers circumferentially arranged about a center axis of said mold member, said flexible elongated fingers being formed of flexible plastic.

3. A mold apparatus according to claim 2, wherein said flexible elongated fingers are formed of a composition having an elasticity sufficient to impart shape-memory thereto.

4. A mold apparatus according to claim 1, wherein said mold member further comprises a projection formed on the bottom of said mold member and surrounding said bore, wherein said fingers are disposed on the surface of said projection.

5. A mold apparatus according to claim 1, wherein said finger alignment member comprises a center metal sleeve for receiving said pin, and an outer sleeve disposed about said center sleeve and including said plurality of curvilinear paths.

6. A mold member according to claim 5, wherein said mold member, said fingers, and said outer sleeve are formed of polyurethane.

7. A mold member according to claim 6, wherein said mold member including said fingers are formed of a polyurethane having a shore hardness of 92A.

8. A die for making a mold member having an open top, a bottom having a bore formed therethrough, and a plurality of flexible fingers projecting from said bottom which circumferentially surround said bore, said die comprising:

a base, a body supported by the base, said body having a plurality of bores formed therethrough, which are circumferentially positioned about a center axis of said body and said bores are substantially equally spaced a radial distance from said center axis and serve to cast said flexible fingers.

9. A method of making a hub of a roller skate wheel, the hub having curvilinear air passages therethrough, using a mold member comprising an open top and a bottom having a bore formed therethrough, and a plurality of flexible fingers projecting from the bottom of said mold member and circumferentially surrounding said bore, said method comprising:

(a) lubricating said mold member;

(b) disposing a pin within said mold member and engaging mold surfaces defining said bore;

(c) positioning a finger alignment member to receive said flexible fingers, said finger alignment member having a plurality of circumferentially arranged curvilinear paths therethrough, said curvilinear paths extending obliquely with respect to a center axis of said finger alignment member and being dimensioned to receive said flexible fingers;

(d) disposing said finger alignment member on said pin such that said curvilinear paths receive said flexible fingers and said flexible fingers are bent to assume a curvilinear shape;

(e) pouring a heated molding agent into said mold member to form said hub; and (f) disengaging said pin and said bore, thus removing said pin and said hub from said mold member.

10. A method of making a roller skate wheel having a hub and a tire, the hub having curvilinear air passages therethrough, using a mold member comprising an open top and a bottom having a bore formed therethrough, and a plurality of flexible fingers projecting from the bottom of said mold member and circumferentially surrounding said bore, said member comprising:

(a) lubricating said mold member;

(b) disposing a pin within said mold member and engaging mold surfaces defining said bore;

(c) positioning a finger alignment member having a plurality of circumferentially arranged curvilinear paths therethrough, said curvilinear paths extending obliquely with respect to a center axis of said finger alignment member and being dimensioned to receive said flexible fingers;

(d) disposing said finger alignment member on said pin such that said curvilinear paths receive said flexible fingers and said flexible fingers are bent to assume a curvilinear shape;

(e) pouring a heated first molding agent into said mold member;

(f) disengaging said pin and said bore, thus removing said pin and said hub from said mold member;

(g) disposing said hub in a tire mold dimensioned to receive said hub;

(h) pouring a second molding agent into said tire mold to form said tire; and (i) removing said hub and tire from said tire mold.

11. A method according to claim 10, wherein said step (f) further comprises machining mechanical interlocks into said hub so as to provide greater structural integrity between said hub and said tire.

12. A method according to claim 10, wherein said step (f) further comprises disposing an adhesive on said hub so as to provide greater structural integrity between said hub and said tire.

13. A method according to claim 11, wherein said step (f) further comprises machining said hub so as to remove any molding anomalies.

14. A method according to claim 12, wherein said step (f) further comprises machining said hub so as to remove any molding anomalies.

15. A mold apparatus according to claim 2, wherein said flexible elongated fingers are formed of polyurethane.

* * * * *